United States Patent [19]

Pearson

[11] Patent Number: 4,836,535

[45] Date of Patent: Jun. 6, 1989

[54] UPPER BODY BUILDING MACHINE

[76] Inventor: Bruce E. Pearson, 409 W. Woodruff, Apt. 1, Searcy, Ark. 72143

[21] Appl. No.: 148,372

[22] Filed: Jan. 25, 1988

[51] Int. Cl.[4] ..... A63B 21/06

[52] U.S. Cl. ..... 272/118; 272/123

[58] Field of Search ..... 272/117, 118, 123, 130, 272/134, 143

[56] References Cited

U.S. PATENT DOCUMENTS

| | | | |
|---|---|---|---|
| 3,572,700 | 3/1971 | Mastropaolo | 272/134 X |
| 4,050,310 | 9/1977 | Keiser | 272/130 X |
| 4,564,194 | 1/1986 | Dawson | 272/118 X |
| 4,585,229 | 4/1986 | Brasher | 272/123 |
| 4,709,919 | 12/1987 | Cano | 272/117 |
| 4,744,560 | 5/1988 | Azari | 272/118 |

FOREIGN PATENT DOCUMENTS

| | | | |
|---|---|---|---|
| 3300073 | 7/1984 | Fed. Rep. of Germany | 272/118 |
| 223926 | 6/1985 | German Democratic Rep. | 272/123 |

*Primary Examiner*—Richard J. Apley
*Assistant Examiner*—Robert W. Bahr
*Attorney, Agent, or Firm*—Stephen D. Carver

[57] ABSTRACT

A power body building machine for athletes, gymnasts, body builders and the like for exercising the upper torso, including the chest, the back, and the shoulders. A rigid, upright, free standing frame includes a pair of rigid, spaced apart, sides which dynamically mount a weight bar assembly which extends horizontally therebetween. A user may enter the machine through the frame and grasp the loaded weight bar assembly, which may be stressed with "outboard" free weight bar assembly is slidably coupled to parallel, rigid, guide rods associated with each of the frame sides rods which establish a vertical travel path and it is manipulated by handles which are slidably mounted upon it for horizontal movement, and which are synchronized with each other by a cable assembly. A user can exercise by concurrently performing hand/arm movements and hand/-wrist rotation while the stressed weight bar is manipulated. Rotatable sprockets are associated with the top and bottom of the machine frame. A chain entrained about the upper and lower sprockets synchronizes the weight bar assembly and enables it to be stressed when moved either upwardly or downwardly. The upper sprockets are synchronized by a rod extending across the top of the frame between them, so that proper control of the weight bar assembly is facilitated.

19 Claims, 3 Drawing Sheets

UPPER BODY BUILDING MACHINE

BACKGROUND OF THE INVENTION

The present invention relates generally to power body building machines for exercising and conditioning muscles. More particularly, the present invention relates to body building or weight training machines for conditioning, strengthening and exercising the upper body muscles including the shoulders, the chest, and the back.

In recent years, body building has become extremely popular with professional and amateur athletes and others who are concerned with physical fitness. It is an important object of body building training to gradually put greater loads on muscles by increasing both weight resistance and the number of repetitions which may be performed. While it has long been known to excercise and build up muscle tissue with bar bells or conventional weights, various machines have been proposed for controlled, power body building. Machines may aid an individual in practicing desired exercises and they are usually designed and adapted to encourage repetitions of a variety of desired body movements. Correct training requires proper kinetics of movement, as well as the the emulation of proper form and ranges of movement. For example, where bending movements are involved it is important that the proper fulcrum position be realized by the athlete. Although it is normally possible to exercise one's muscles in a complete workout without using "machine" type devices, it has been found properly designed exercising machines help encourage both the novice and experienced bodybuilder to observe proper form and routine. When a athlete regularly trains on a properly designed machine with correctly installed accessories, his strength, endurance and speed will gradually by surely increase.

It is important in body building to develop a thickly muscled chest. Upper exercises can include various forms of weight lifting and machine-assisted exercises wherein the arms and hands and the muscles therein are vigorously and repeatedly stressed, and the chest is similarly conditioned. A variety of bench press exercises, for example, are known for exercising the pectoral muscle group over the upper rib cage. Pectoral muscles contract to pull and exercise the homorous. By pulling the homorous across the body at various angles, one can stress different parts of the pectoral muscles. It is also important to exercise the upper body by exercises designed to expand the rib cage. A variety of chest exercises involving bench presses and the like are also known. Incline and decline presses are often performed with bar bells, but the modern trend is to use training equipment such as a universal gymnasium machine or a Smith machine.

Shoulder development and training is also important. Shoulder training involves stressing of the deltoid muscles, and essentially three types of deltoid movements are commonly encouraged. These are pushing exercises, leverage movements, and pulling exercises. In an effort to accomodate all of these typically movements, it is desirable to provide means whereby the arms can be stressed laterally, stressed while pushing upwardly, and stressed in a pulling moment. While certain prior art devices such as Smith machines employ vertical runners associated with a loaded weight bar assembly, most of them require the hands to be maintained in a fixed position relative to the weighted bar assembly. No know prior art exercising machines appear to exist which enable the wrist of the hands to be significantly twisted contemporaneously with lateral and vertical upper body movements.

Proper body building technique also requires adherence to safety procedures. One important safety recommendation is that the athlete use "spotters" to stand near him when "free weights" such as barbells are being lifted. It is also prudent to have some form of safety-catch rack or equipment so that heavy barbells cannot be dropped in response to a muscle cramp or the like. Machines adapted to "control" weights such as barbells are ideally adapted to promote these safety aspects.

I am unaware of any machine which operationally combines "free weight" compatibility with selective weight stack stressing, while concurrently providing rotary hand and wrist movement with vertical and horizontal arm and upper torso movement. I have provided a machine which safely enables an exerciser to strengthen, condition and build the upper torso, which simultaneously urges the user to maintain proper form and a high degree of safety.

SUMMARY OF THE INVENTION

The present invention comprises an upper body building machine for athletes, gymnasts, body builders and the like which is used primarily for exercising the upper torso, including the chest, the back, and the shoulders. A user may enter the machine and grasp a properly loaded weight bar assembly, which may be stressed with "outboard" free weights or one or more of a plurality of stacked weights.

The machine comprises a rigid, upright, free standing frame of dimensions sufficient to allow an exerciser to enter its interior. A rigid frame bottom adapted to be supported upon a gym floor, for example, includes a pair of opposite, spaced apart sides which extend upwardly to a transverse top. The sides dynamically mount the weighted structure of the machine, and control the movement thereof.

The weight bar assembly is dynamically controlled by the machine for safety and reliability, and it may assume a variaty of orientations while effectuating a plurality of complex movements. The weight bar assembly operationally extends generally transversely across the machine frame, and it is coupled to parallel, rigid, guide rods associated with each of the frame sides. The guide rods establish a path for the weight bar assembly, which is coupled at its opposite ends to the rods by suitable linear bearings. The weight bar assembly is manipulated by handles which are slidably mounted for horizontal movement relative to the weight bar assembly. The handles can thus move horizontally so that the user may exercise by concurrently performing hand/-arm movements and hand/wrist rotation while the stressed weight bar is manipulated.

In the best mode of the invention, the weight bar assembly is controlled by cooperating pairs of sprocket and chain assemblies which inter-link the weight bar with base mounted weight stacks. Rotatable sprockets are associated with the top and bottom of the machine frame. An elongated cable, preferably a chain, is entrained about the upper and lower sprockets to synchronize the weight bar assembly and enable it to be stressed when moved either upwardly or downwardly. The upper pulleys or sprockets are synchronized by a rod extending across the top of the frame between them, so that proper control of the weight bar assembly and the heavy weights borne by it is facilitated. Thus stressed pulling and pushing exercises for developing and exercising the upper body are facilitated.

Preferably the weight bar assembly comprises a pair of handle assemblies which are horizontally movable across it. Each handle assembly includes a central, slidable bearing collar adapted to horizontally move relative to an inner weight bar center segment. In addition, twistable handle portions emanating from the handle assemblies may be conveniently grasped by the hands of the exerciser and twisted to any comfortable position to facilitate a variety of hand/arm and hand/wrist positions.

In the best mode, a cable assembly associated with each of the handle assemblies synchronizes relative movement thereof. In other words, the handles are forced to maintain an equal operating distance from their adjacent side of the frame. It is also preferred that the central weight bar frame member be shiftable from a position wherein the handles point downwardly and position where the handles point upwardly. Therefore, the weight bar central portion terminates in opposite sleeves which may be user splined in a position desired to effectuate upper operation. Accordingly, in the best mode, synchronizer rods associated with the handle assemblies penetrate the bearing collars to prevent the handle assemblies from rotating about the weight bar means.

Thus a basic object of the present invention is to provide an exercising machine for enabling an exerciser to condition, strengthen and build the chest, shoulders and back muscles and the like.

Another basic object of the present invention is to provide an exercising machine of the character described which safely distributes and controls the weight load.

Another basic object is to provide an exercise machine as described which encourages maintenance of proper form.

Yet another object of the present invention is to provide a weight training system of the character described wherein the weights are not free to fall past a set point.

A fundamental object of the present invention is to provide an exercising machine of the character described which combines forward and rearward body movement along with upward and downward weight movement.

A related object is to provide a weight exercising machine for building the upper body which facilitates both muscle isolation and stress intensification.

A still further object is to provide a machine wherein a variaty of bench press exercises can be performed to exercise the pectorals muscle group over the upper rib cage, by allowing the humorous to be pulled and stretched from a number of different angles.

Yet another important object of the present inventions is to provide a machine to properly and safely exercise and expand the rib cage.

A further object of the present invention is to provide a body building machine which combines "free weight" compatibility with selective weight stack stressing.

It is another important object to provide a machine for strengthening the shoulders and particularly the deltoid muscles.

Another object is to provide a machine which accomplishes the three particular movements used in strengthening and building the deltoid muscles namely pushing exercises, leverage movements and pulling exercises.

Yet another object is to provide means whereby the arms can be stressed laterally, stressed while pushing upwardly, and stressed in a pulling moment.

Another object is to provide a machine which enables the wrists of the hands to be twisted contemporaneously with lateral and vertical arm and upper torso movements.

It is a basic object to provide a machine to properly stress the back muscles while preserving back safety.

A related object is to provide a machine to exercise all three muscle groups in the back.

Still another object is to provide a machine whereby the arms can be stressed laterally, stressed while pushing upwardly, and stressed in a pulling moment.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
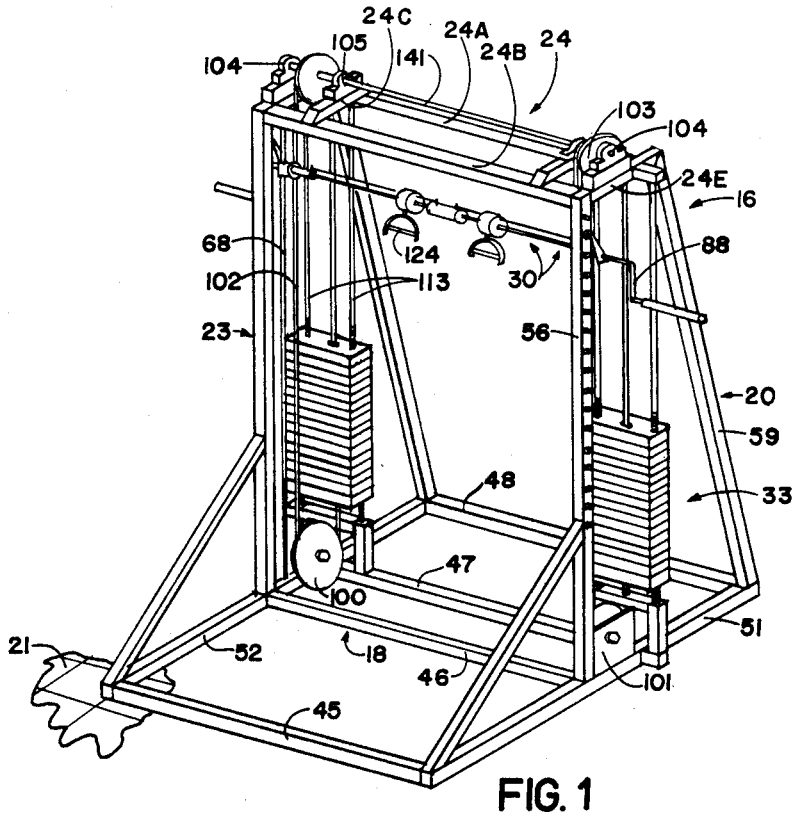
FIG. 1 is a fragmentary, isometric view illustrating the best mode of my Upper Body Building Machine.
Figure 2:
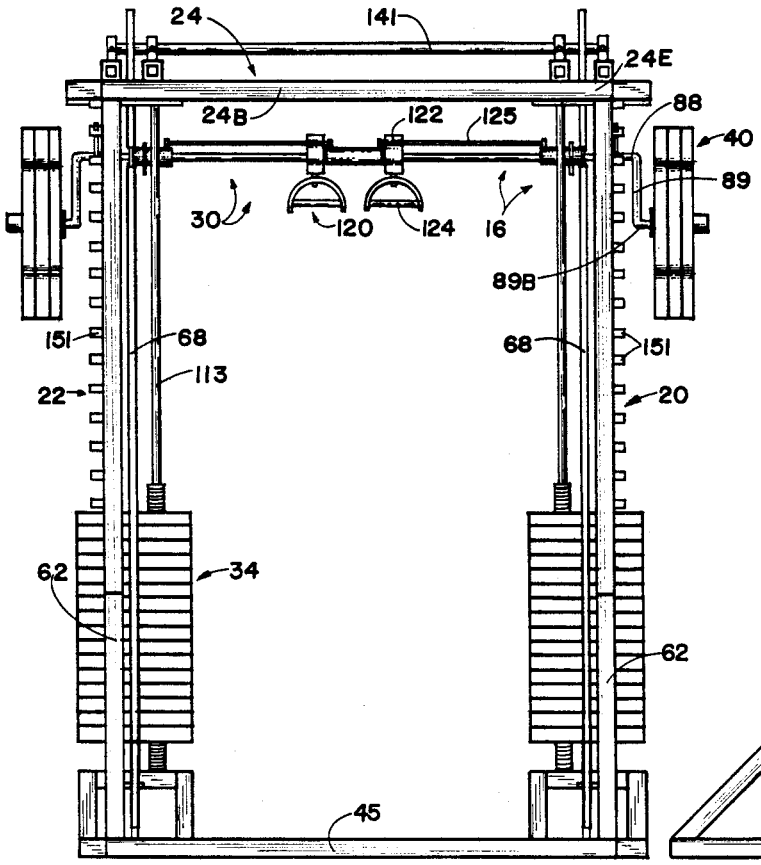
FIG. 2 is a front elevational view thereof showing the weight bar assembly in a locked, upper position fitted with optional free weights at its extremities.
Figure 3:
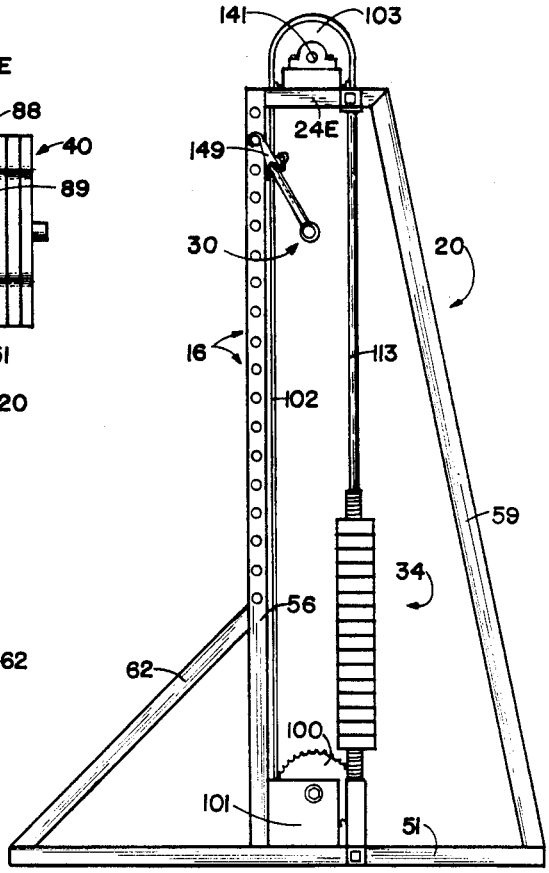
FIG. 3 is a side elevational view thereof, taken from a position generally to the right of FIG. 2, and with the free weights omitted for clarity.

With initial reference now directed to FIGS. 1 through 3 of the appended drawings, an upper body building machine constructed in accordance with the best mode of the present invention has been generally designated by the reference numeral 16. Machine 16 comprises a rigid frame consisting of a base 18 adapted to be disposed upon a suitable, preferably flat supporting surface 21, a pair of symmetrical sides generally indicated by the reference numerals 20 and 22, and a rigid top generally indicated by reference numeral 24. Top 24 comprises a pair of spaced apart rigid members 24A and 24B which are braced by cross pieces 24C and ends 24E. An elongated weight bar assembly, generally designated by the reference numeral 30, dynamically extends between sides 20 and 22, and it is stressed either by the weight stack assemblies 33, 34, or it may be stressed by one or more free weights 40 (FIG. 2). Thus once properly stressed, the weight bar assembly can provide variable tension when pushed or pulled upwardly or downwardly, or when lifted upwardly from the bottom of the frame.

The frame bottom 18 comprises a plurality of rails 45–48 which rigidly extend between elongated frame side rails 51 and 52. Each frame side member 20, 22 comprises an upwardly extending vertical member 56 which extends from frame rail 51 and terminates in top end 24E to which an angled side member 59 is also affixed. It will also be noted that a smaller, angled frame brace 62 extends at an incline from the front of frame side rails 51, 52 to the vertical side members 56.

Figure 6:
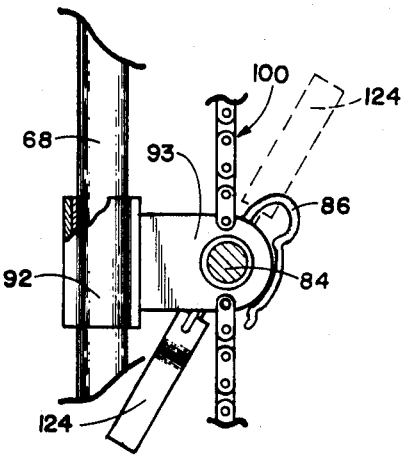
FIG. 6 is an enlarged, fragmentary, side elevational view showing portions of the preferred weight bar assembly mounting and chain system, with alternative positions indicated in dashed lines, and with portions thereof broken away or shown in section for clarity.
Figure 7:
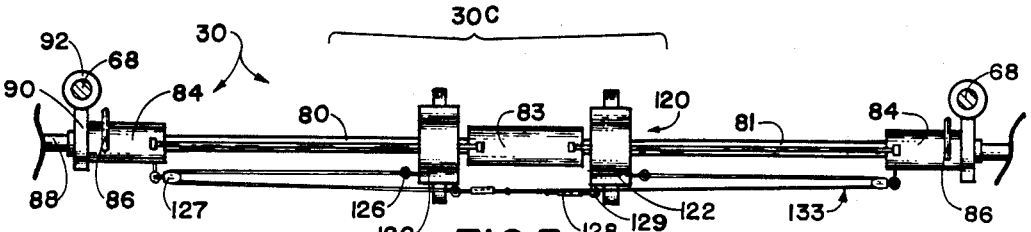
FIG. 7 is an enlarged, fragmentary, top plan view of the weight bar assembly illustrating the handle system and synchronization cables, with portions thereof shown in section for clarity.

As best seen in FIGS. 2, 6, and 7 each of the sides additionally includes a vertically extending guide rod 68 to which the wieght bar assembly 30 is operationally mounted. As will be described hereinafter in detail, the weight bar assembly 30 is adapted to be grasped by the hands of the user, who may then push or pull it upwardly or downwardly at his option. In addition, the handles can be moved axially (i.e. inwardly or outwardly from the "center" position shown in FIG. 2). Further, means are provided to synchronize axial movement of the handles.

The weight bar assembly 30 comprises a central portion broadly designated by the reference numeral 30C (FIG. 7) consisting of elongated rigid rod elements 80 and 81 which are splined together in a central union 83. Rods 80 ad 81 terminate in similar couplings 84 which are fastened via identical pins 86 to outer terminal ends 88. Terminal ends 88 terminate in off-set portions 89 (see FIGS. 2 and 8), and terminal portions 89B to which one or more free weights, such as weights 40 (FIG. 2) may be attached to stress the apparatus. Central weight bar portion 30C may be rotated relative to terminal ends 88 by removal of pins 86, so that the handle assemblies 120 may be configured in either a downwardly pointing position (i.e. FIG. 8) or an upwardly pointing position (i.e. FIG. 9).

The terminal couplings 84 interconnect with suitable tabs 90 terminating in bearing collars 92 which reciprocally, slidably, move relative to the guide rods 68. As best seen in FIG. 6, for example, the sleeves 92 include outwardly projecting tabs 93 which interconnect the weight bar assembly with the chain means to be hereinafter described.

Figure 4:
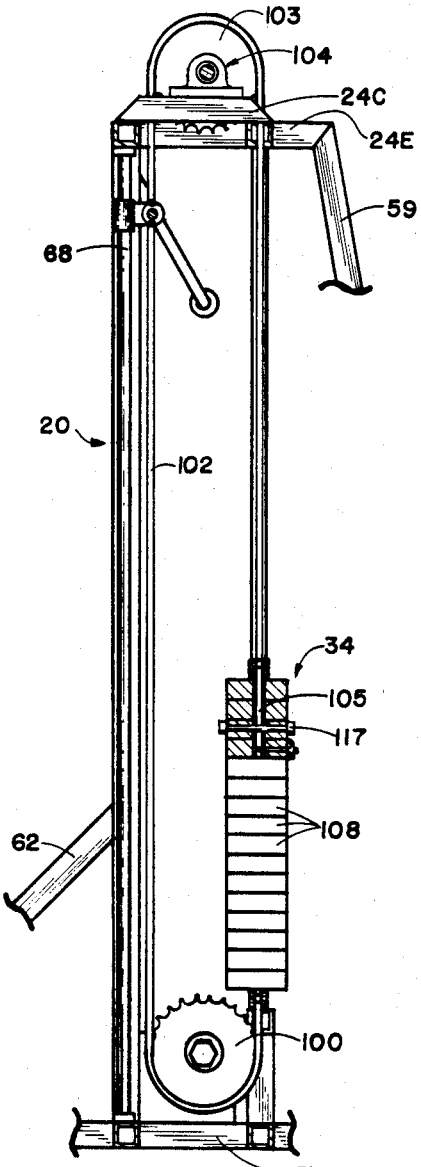
FIG. 4 is an enlarged scale, fragmentary, side elevational view thereof similar to FIG. 3, with portions shown in section for clarity.
Figure 5:
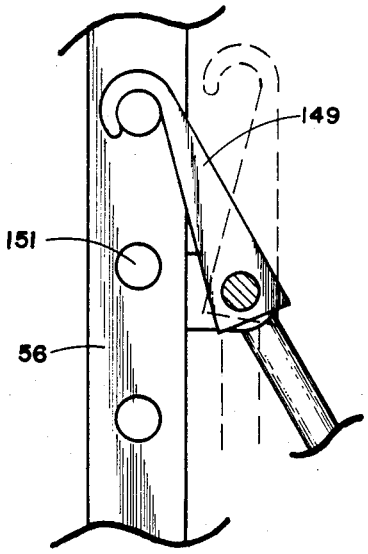
FIG. 5 is an enlarged, fragmentary, side elevational view showing a weight bar position lock, with alternative positions indicated in dashed lines, and with portions thereof shown in section for clarity.
Figure 8:
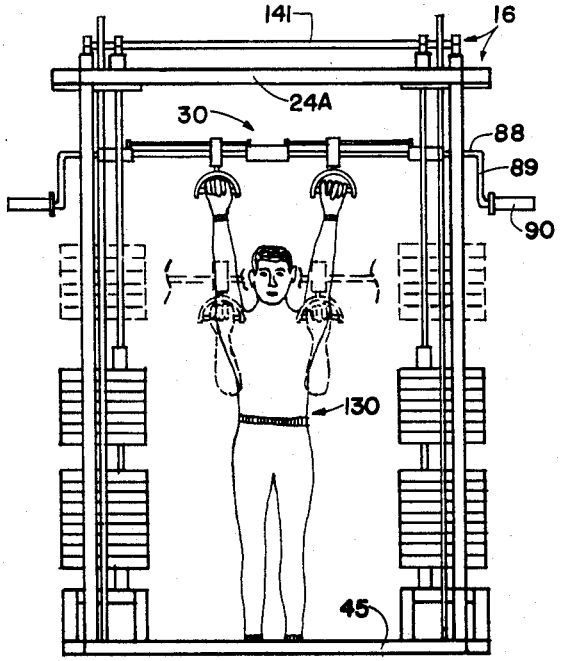
FIG. 8 is a pictorial view, generally illustrating the machine deployed for a standing pull exercise.
Figure 9:
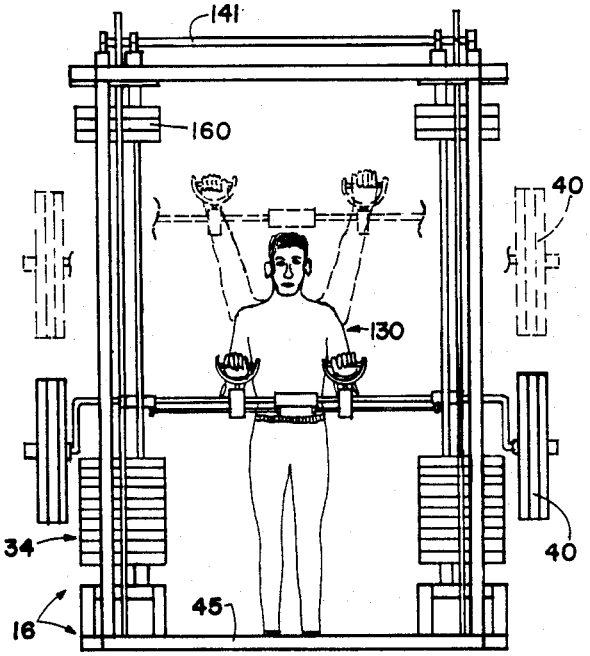
FIG. 9 is a pictorial view, generally illustrating the machine deployed for standing lift press exercises.

A sprocket system including an endless chain is employed to control, load, and synchronize the weight bar assembly. With primary reference is directed to FIGS. 3 and 4, it will be noted that lower sprockets 100 are secured for rotation relative to the safety plates 101. Upper sprockets 103 mounted at the top of the frame are splined to synchronizer rod 141 which extends through pillow blocks 104 and 105 at each side. An endless chain 102 is revolvably associated with the upper and lower sprockets. Chain 102 penetrates suitable orifices such as orifice's 105 defined in the aligned plurality of individual weights 108 forming the weight stacks 33, 34. The chain associated with each side of the frame is identical, and interconnection with the weight stacks is the same. In addition, each weight stack is vertically controlled by a pair of spaced-apart synchronizing control rods 113 which are spaced-apart on opposite sides of the chain through suitable orifices also defined in the weight block members. Thus, when the weight stacks are manipulated vertically as seen in FIGS. 8 and 9, they are moved vertically upwardly or downwardly, but they remain relatively horizontally aligned relative to one another because torsional displacements are prevented by the rods 113 described.

With reference now to FIGS. 2, and 7–9, the weight bar assembly includes a pair of movable handle members broadly designated by the reference numerals 120. Each of the handle members comprises a slidable, horizontally movable collar 122 to which a handle 124 is twistably fitted. In other words, the handles 124 may be rotated by the hands or wrists of the user, relative to the collars 122. Such rotation is possible whether or not collars 122 (and thus the entire handles 120) are moving horizontally inwardly or outwardly from weight bar means center 83, and whether or not weights are being moved vertically by the user 130 of the device. As best revealed in FIG. 7, the collars and thus the handle assemblies can move between the illustrated position in close proximity to center 83, or to extreme positions adjacent 84. However, relative rotation of the collars (and thus the handle assemblies) about the weight bar rods 80 or 81 is prevented by rods 125 (FIG. 2) which extend from couplings 84 and penetrate suitable orifices in the collars.

Axial handle movement is synchronized by an elongated cable assembly 133 which interconnects the collar members as shown in FIG. 7. For example, the cable end attached to collar 122 at junction 126 is trained about pulley 127, and terminates in fitting 128 attached to the companion collar at eyelet 129. The cable assembly, when wired as indicated, insures that when one handle assembly moves a given distance either to the left or the right, appropriate equalizing cable displacement facilitated and controlled by concurrent movement of the companion handle insures synchronization.

As the weight bar assembly is moved upwardly or downwardly, the chain 102 will thus rotate about the upper and lower sprockets. The weight stack members will be optionally coupled to the apparatus through the pins 117 (FIG. 4), so that weight stack members may be employed or omitted altogether. Of course, a variety of relatively heavy free weights such as weights 40 (FIGS. 1, 2 and 9) may be added to the extreme ends of the weight bar assembly. When extremely heavy free weights are employed, and substantial stress is placed upon the upper torso of the user (when the weight bar assembly is elevated above the user's head) a substantial degree of safety is realized.

First, the upper sprockets 103 are rotatably synchronized by axle 141 extending between them to insure equal chain movements on each side of the frame. This helps to maintain the weight bar assembly in a generally horizontal orientation, and prevents chain twisting. In addition, the ends of the weight bar assembly are associated with brake locks 149 which are adapted to be rotated into contact with one of a plurality of spaced apart locking nubs 151 which extend outwardly on opposite sides of the frame from the vertical member 56. The weight bar assembly can thus be quickly locked as indicated in any one of the variety of positions. Finally, for ease of use and convenience and purposes of safety, approximately 3 of the nested weight block members such as members 160 (FIG. 9) can be operationally associated with the chain 102 previously described so as to counter balance the mass of the weight bar assembly 30. This counter balance phenomena can be important, for example, when the weight bar assembly is "unloaded" by the removal of free weights 40.

Turning now primarily to FIGS. 8 through 11, FIG. 8 illustrates how user 130 may grab the handles 120 for either pushing or pulling the weight bar assembly in the manner illustrated. On the other hand, hand maneuvers of FIG. 9 are also facilitated, wherein the user 130, while standing erect, can condition his wrist by pulling on the handles while he lifts the weight bar assembly over his head.

Figure 10:
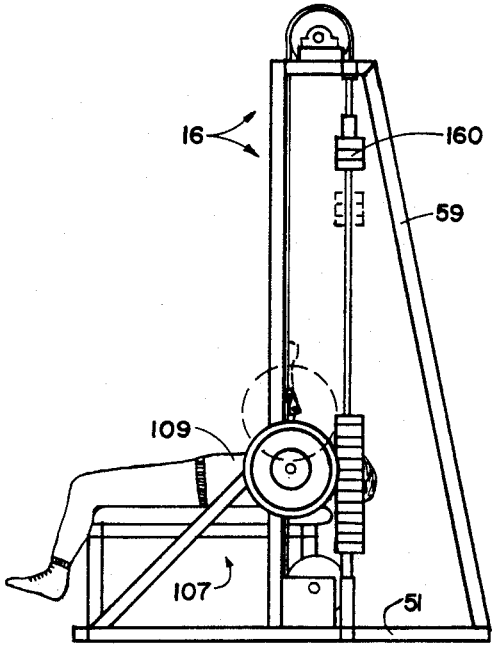
FIG. 10 is a pictorial side view of the machine with the optional bench rest installed, generally illustrating alternate positions during use for a bench press exercise; and, FIG. 11 is a pictorial side view similar to FIG. 10 but illustrating alternate positions during use for an inclined pull exercise.
Figure 11:
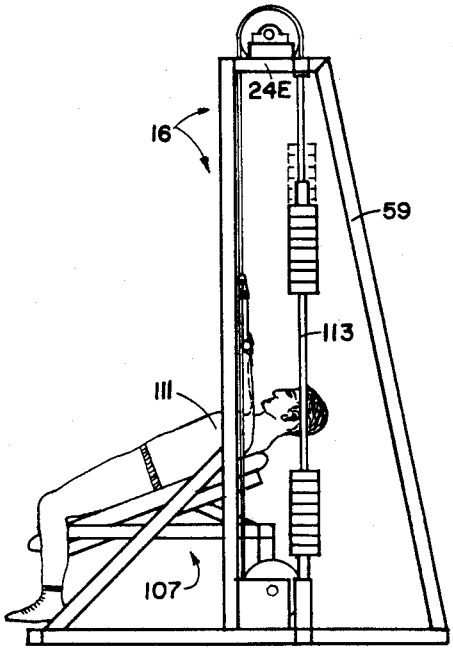

FIG. 10 illustrates how an optional weight can be attached to the frame and the handles can be lowered as described as to facilitate a pushing or pulling operation of the weight bar assembly. User 109 is positioned upon the optional weight bench 107 fitted to the frame bottom. Additionally the weight bench may be modified or maneuvered as in FIG. 11 wherein the user 111 has employed a desired load form the weight stacks stress his arms and upper torso while pulling the weight bar assembly downwardly toward him. The user 111 may variously angle his body and torso as to produce varying stresses and muscle moments in a variety of different positions.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A body building machine for enabling a user such as an athlete, gymnast or body builder to exercise the chest, back shoulders and other upper body muscles, said machine comprising:

a rigid frame adjusted to be disposed upon a supporting surface such as a gymnasium floor, the frame comprising a bottom, a top, and a pair of spaced-apart, generally parallel sides extending upwardly from said bottom said top;

each of said sides including rigid, elongated guide rod means extending between said frame bottom and said frame top;

weight bar means operationally extending generally horizontally across said machine between said sides for generally vertical displacement by a user of said machine, said weight bar means comprising mounting means restrained by said guide rod means and ends adapted to be stressed by suitable weights;

handle means operatively coupled to said weight bar means, said handle means comprising bearing collar portions coaxially, slidably coupled to said weight bar means permitting horizontal movement with respect thereto and twistable portions associated with said collar portions adapted to be grasped by the hands of said user, thereby concurrently permitting generally horizontal hand/arm movement and hand/wrist rotation with up and down vertical displacements of said weight bar means; and, said weight bar means comprising:

cable means for synchronizing horizontal movements of said handle means along said weight bar means;

a central segment which is selectively rotatable relative to said mounting means for permitting said handle means to be oriented either in a position pointed toward said frame bottom or an opposite position pointing toward said frame top; and means for preventing relative rotation of said handle means collar portions relative to said weight bar means central segment.

2. The machine as defined in claim 1 including brake means associated with said weight bar means for releasably securing the weight bar means in a fixed position.

3. The machine as defined in claim 1 including a rotatable suspension assembly for dynamically stressing and controlling said weight bar means, said suspension assembly comprising:

an upper sprocket system secured upon said frame;

a lower sprocket system secured to said frame beneath said upper sprocket system; and, chain means trained about said upper and lower sprocket systems for engaging said weight bar means.

said mounting means comprising a bearing sleeve associated with each end of said weight bar means and coaxially, slidably fitted to an adjacent one of said guide rods, said bearing sleeve coupled to said chain means for linking the chain means to said weight bar means.

4. The machine as defined in claim 1 including a rotatable suspension assembly for dynamically stressing and controlling said weight bar means, said suspension assembly comprising:

an upper sprocket system secured upon said frame;

a lower sprocket system secured to said frame beneath said upper sprocket system; and, chain means trained about said upper and lower sprocket systems for engaging said weight bar means.

5. The machine as defined in claim 4 wherein said mounting means comprises a bearing sleeve associated with each end of said weight bar means and coaxially, slidably fitted to an adjacent one of said guide rods, said bearing sleeve coupled to said chain means for linking the chain means to said weight bar means.

6. The machine as defined in claim 4 wherein said machine comprises weight stack means disposed near the bottom of said frame and comprising a plurality of stacked, individual weights, and said chain means penetrates suitable orifices in said weight stack means and includes coupling means for grasping variable numbers of weights from said stack to tension said weight bar means and bias it upwardly so that a user of said machine may exercise by pulling the weight bar means downwardly toward him.

7. The machine as defined in claim 6 including synchronizing rod means vertically associated with said chain means to prevent twisting of said chain means.

8. The machine as defined in claim 6 wherein said upper sprocket system comprises a sprocket rotatably secured on top of each side of said frame, and said machine comprises axle means extending across the top of said frame between said upper sprocket for synchronizing said chain means.

9. A body building machine for enabling a user such as an athlete, gymnast or body builder to exercise the chest, back and shoulders and the muscles therein, said machine comprising:

a rigid frame adapted to be disposed upon a supporting surface such as a gymnasium floor, the frame comprising a bottom, a top, and a pair of spaced-apart, generally parallel sides extending upwardly from said bottom to said top;

each of said sides including rigid, elongated guide rod means extending between said frame bottom and said frame top;

weight bar means operationally extending generally horizontally across said machine between said sides for generally vertical displacement by a user of said machine, said weight bar means comprising mounting means restrained by said guide rod means and ends adapted to be stressed by suitable weights;

handle means comprising a pair of handles slidably associated with said weight bar means and selectively concurrently axially displaceable with respect thereto, said handle means comprising collar portions slidable along said weight bar means and twistable handles attached to said collars adapted to be grasped by the hands of said user, thereby concurrently permitting generally horizontal hand/arm movement and hand/wrist rotation with up and down vertical displacements of said weight bar means;

a rotatable suspension assembly for dynamically stressing and controlling said weight bar means, said suspension assembly comprising:

an upper sprocket system secured upon said frame;

a lower sprocket system secured to said frame beneath said upper sprocket system; and, chain means trained about said upper and lower sprocket systems for engaging said weight bar means;

said mounting means comprises a bearing sleeve associated with each end of said weight bar means and coaxially, slidably fitted to an adjacent one of said guide rods, and each bearing sleeve being coupled to said chain means for linking the chain means to said weight bar means; and, brake means associated with said weight bar means for releasably securing the weight bar means in a fixed position.

10. The machine as defined in claim 9 wherein said weight bar means comprises cable means for synchronizing horizontal movements of said handle means portions along said weight bar means.

11. A body builder machine for enabling a user such as an athlete, gymnast or body builder to exercise the chest, back and shoulders and the muscles therein, said machie comprising:

a rigid frame adapted to be disposed upon a supporting surface such as a gymnasium floor, the frame comprising a bottom, a top, and a pair of spaced-apart, generally parallel sides extending upwardly from said bottom section, to said top;

each of said sides including rigid, elongated guide rod means extending between said frame bottom and said frame top;

weight bar means operationally extending generally horizontally across said machine between said sides for generally vertical displacement by a user of said machine, said weight bar means comprising mounting means restrained by said guide rod means and ends adapted to be stressed by suitable weights;

handle means operatively coupled to said weight bar means, said handle means comprising bearing collar portions coaxially, slidably coupled to said weight bar means permitting horizontal movement with respect thereto and twistable portions associated with said collar portions adapted to be grasped by the hands of said user, thereby concurrently permitting generally horizontal hand/arm movement and hand/wrist rotation with up and down vertical displacements of said weight bar means;

a rotatable suspension assembly for dynamically stressing and controlling said weight bar means, said suspension assembly comprising:

an upper sprocket system secured upon said frame;

a lower sprocket system secured to said frame beneath said upper sprocket system;

chain means trained about said upper and lower sprocket systems for engaging said weight bar means; and, means for synchronizing said upper sprocket system;

said mounting means comprises a bearing sleeve associated with each end of said weight bar means and coaxially, slidably fitted to an adjacent one of said guide rods, said bearing sleeve coupled to said chain means for linking the chain means to said weight bar means;

means associated with said weight bar means for synchronizing horizontal movements of said handle means collar portions along said weight bar means, and, weight stack means disposed near the bottom of said frame and comprising a plurality of stacked, individual weights, said chain means including coupling means for grasping variable number of weights from said stack to tension said weight bar means and bias it upwardly so that a user of said machine may exercise by pulling the weight bar means downwardly toward him.

12. The machine as defined in claim 11 wherein said weight bar means comprises a central segment which is selectively rotatable relative to said mounting means for permittinng said handle means to be oriented either in a position pointed toward said frame bottom or an opposite position pointing toward said frame top.

13. The machine as defined in claim 12 wherein said weight bar means comprises stablilizer rod means for preventing relative rotation of said handle means collar portions relative to said weight bar means central segment.

14. A body building machine for enabling a user such as an athlete, gymnast or body builder to exercise his or her chest, back, shoulders and other upper body muscles, said machine comprising:

a rigid frame adapted to be disposed upon a supporting surface such as a gymnasium floor, the frame comprising a bottom, a top, and a pair of spaced-apart, generally parallel sides extending upwardly from said bottom to said top;

each of said sides comprising rigid, elongated guide rod means extending between said frame bottom and said frame top;

weight bar means operationally extending generally horizontally across said machine between said sides for generally vertical displacement by a user of said machine, said weight bar means comprising mounting means coaxially, slidably fitted to said guide rods means and ends adapted to be stressed by suitable weights;

handle means operatively coupled to said weight bar means, said handle means comprising bearing collar portions coaxially, slidably coupled to said weight bar means selectively permitting horizontal movement with respect thereto and twistable portions associated with said collar portions adapted to be grasped by the hands of said user, thereby concurrently permitting generally horizontal hand/arm movement and hand/wrist rotation with up and down vertical displacements of said weight bar means;

said weight bar means comprising a central segment which is selectively rotatable relative to said mounting means for permitting said handle means to be oriented either in a position pointed toward said frame bottom or an opposite position pointing toward said frame top and means for preventing relative rotation of said handle means collar portions relative to said weight bar means central segment;

brake means associated with said weight bar means for releasably securing the weight bar means in a fixed position; and, a rotatable suspension assembly for dynamically stressing and controlling said weight bar means, said suspension assembly comprising:

an upper sprocket system secured upon said frame;

a lower sprocket system secured to said frame beneath said upper sprocket system; and, chain means trained about said upper and lower sprocket systems for engaging said weight bar means, said chain means linked to said weight bar means;

weight stack means disposed near the bottom of said frame and comprising a plurality of stacked, individual weights, said chain means penetrating suitable orifices in said weight stack means and including coupling means for grasping variable numbers of weights from said stack to tension said weight bar means so that a user of said machine may exercise by pulling the weight bar means downwardly toward him.

15. The machine as defined in claim 14 including cable means for synchronizing horizontal movements of said handle means collar portions along said weight bar means.

16. The machine as defined in claim 15 wherein said upper sprocket system comprises a sprocket rotatably secured on top of each side of said frame, and said machine comprises axle means extending across the top of said frame between said upper sprockets for synchronizing said chain means.

17. A body building machine for enabling a user such as an athlete, gymnast or body builder to exercise the chest, back, shoulders and other upper body muscles, said machine comprising:

rigid frame means adapted to be disposed upon a supporting surface such as a gymnasium floor, the frame means comprising a bottom, a top, and a pair of spaced-apart, generally parallel sides extending upwardly from said bottom to said top;

each of said sides comprising rigid, elongated guide rod means extending between said frame means bottom and said frame means top;

weight bar means operationally extending generally horizontally across said machine between said sides for generally vertical displacement by a user of said machine, said weight bar means comprising mounting means restrained by said guide rod means for generally vertical movements with respect thereto and ends adapted to be stressed by suitable weights;

handle means comprising a pair of spaced apart handles operatively coupled to said weight bar means, said handle means comprising means slidably coupled to said weight bar means selectively permitting horizontal movement with respect thereto and twistable portions adapted to be grasped by the hands of said user, thereby concurrently permitting generally horizontal hand/arm movement and hand/wrist rotation with up and down vertical displacements of said weight bar means;

means for synchronizing horizontal movements of said handle means along said weight bar means;

said weight bar means comprising means selectively rotatable relative to said mounting means for permitting said handle means to be oriented either in a position pointed toward said frame means bottom or an opposite position pointing toward said frame means top and means for preventing relative rotation of said handle means collar portions relative to said weight bar means central segment;

brake means associated with said weight bar means for releasably securing the weight bar means in a fixed position;

a rotatable suspension assembly for dynamically stressing and controlling said weight bar means, said suspension assembly comprising:

an upper sprocket system secured upon said frame means;

a lower sprocket system secured to said frame means beneath said upper sprocket system; and, chain means trained about said upper and lower sprocket systems for engaging said weight bar means;

said mounting means comprising bearing means associated with each end of said weight bar means and coaxially, slidably fitted to an adjacent one of said guide rods, said bearing means coupled to said chain means for linking the chain means to said weight bar means;

weight stack means disposed near the bottom of said frame means and comprising a plurality of stacked, individual weights, said chain means penetrating suitable orifices in said weight stack means and comprising coupling means for grasping variable numbers of weights from said stack to tension said weight bar means so that a user of said machine may exercies by pulling the weight bar means downwardly toward him.

18. The machine as defined in claim 17 wherein said upper sprocket system comprises a sprocket rotatably secured on top of each side of said frame means, and said machine comprises axle means extending across the top of said frame means between said upper sprocket for synchronizing said chain means.

19. The machine as defined in claim 18 wherein said means for synchronizing horizontal movements of said handle means comprises pulley means associated with said handle means and cable means entrained about said pulley means.

* * * * *